United States Patent [19]

Yamazaki et al.

[11] 4,089,163

[45] May 16, 1978

[54] EXHAUST PORT LINER FOR ENGINE

[75] Inventors: Shuichi Yamazaki; Shinichi Shimada, both of Kamifukuoka, Japan

[73] Assignee: Honda Giken Kogyo Kabushiki Kaisha, Tokyo, Japan

[21] Appl. No.: 677,667

[22] Filed: Apr. 16, 1976

[30] Foreign Application Priority Data

| | | |
|---|---|---|
| Apr. 22, 1975 | Japan | 50-54077[U] |
| Apr. 24, 1975 | Japan | 50-55101[U] |
| Apr. 28, 1975 | Japan | 50-56856[U] |

[51] Int. Cl.[2] ..... F01N 3/10

[52] U.S. Cl. ..... 60/282; 123/193 H

[58] Field of Search ..... 60/272, 282; 123/191 A, 123/193 H, 188 GC

[56] References Cited

U.S. PATENT DOCUMENTS

| | | | |
|---|---|---|---|
| 1,655,149 | 1/1928 | Lee | 123/193 H |
| 2,260,656 | 10/1941 | Bell | 60/272 |
| 3,969,893 | 7/1976 | Sakurai | 60/282 |

FOREIGN PATENT DOCUMENTS

| | | | |
|---|---|---|---|
| 145,061 | 12/1920 | United Kingdom | 123/193 H |
| 473,472 | 10/1947 | United Kingdom | 123/191 A |

*Primary Examiner*—Douglas Hart
*Attorney, Agent, or Firm*—Lyon & Lyon

[57] ABSTRACT

An exhaust port liner for an internal combustion engine is formed of thin wall heat resistant material and is provided with an entrance opening at one side to receive exhaust gases discharged from an engine combustion chamber. A poppet type valve which closes against a stationary seat has a portion which extends through the entrance opening of the liner and also through an aperture in a wall of the liner. This aperture may also receive a portion of the valve stem guide and the liner may be fixed to the valve stem guide in the region of said aperture. The liner has a discharge opening and a support flange supporting the liner encircles the discharge opening. A peripheral layer of heat insulating material may be provided on the liner and this heat insulating material may be confined within a shell forming a part of the liner.

5 Claims, 5 Drawing Figures

EXHAUST PORT LINER FOR ENGINE

This invention relates to internal combustion engines and is particularly directed toward improvements in exhaust port liners for the exhaust ports of such engines. The purpose of such exhaust port liners is to minimize cooling of the exhaust gases after they pass the exhaust valve and before they pass into an exhaust system having one or more exhaust reaction chambers. Maintaining a high temperature of the exhaust gases for a relatively long period of time minimizes the quantities of unburned hydrocarbons and carbon monoxide discharged into the atmosphere.

In accordance with this invention, an exhaust port liner is provided which has an entrance opening to receive exhaust gases and which has an aperture through which a portion of the exhaust valve passes. The liner is spaced from the enclosing walls of the exhaust port and it is provided with a support flange adjacent its discharge opening. The support flange has a surface prepared for contact with a flange surface provided on an exhaust pipe leading into an exhaust reaction chamber within the exhaust passage.

Means are provided for closing the aperture in the liner and for securing the liner to the valve stem guide. The liner may be provided with a peripheral layer of heat insulating material contained within a shell forming a part of the liner, thereby further restricting loss of heat from the exhaust gases.

Other and more detailed objects and advantages will appear hereinafter.

Figure 1:
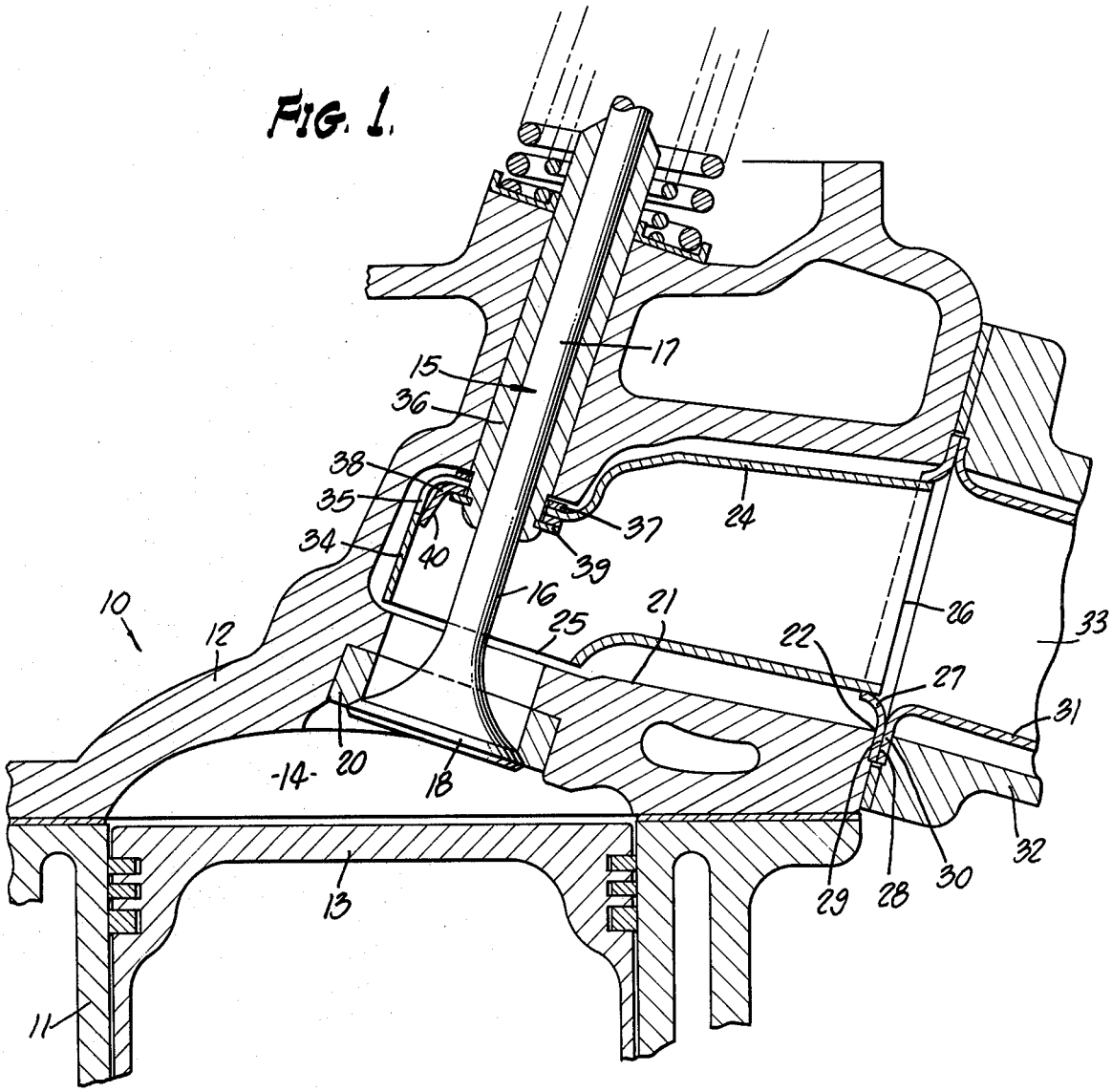
FIG. 1 is a sectional elevation partly broken away showing the preferred embodiment of this invention.

Referring to the drawings, the internal combustion engine generally designated 10 has a block 11 and a cylinder head 12 cooperating with the piston 13 to form a combustion chamber 4. An exhaust valve assembly generally designated 15 includes a poppet type valve 16 having a valve stem 17 and a valve head 18. The valve head 18 closes against the stationary valve seat 20. An exhaust port 21 is formed in the water-cooled cylinder head 12 and extends from the valve seat 20 to the discharge end thereof at 22.

In accordance with this invention, a thin wall exhaust port liner 24 formed of heat resistant material is inserted into the exhaust port 21 from the discharge end 22 but spaced from the walls thereof. The liner 24 has an entrance opening 25 at one side positioned to receive exhaust gases from the combustion chamber 14 when the exhaust valve 16 is open. The liner 24 has a discharge opening 26. A support flange 27 slidably supports the liner 24 in a location adjacent to the discharge opening 26, and this support flange has a surface 28 adapted to contact a similar surface 29 on a flange 30 formed at the entrance end of the exhaust pipe 31 extending into the exhaust system. The flanges 27 and 30 are clamped together by conventional means (not shown) which clamps a housing 32 surrounding and enclosing the exhaust pipe 31 to the cylinder head 12. The exhaust pipe 31 and the housing 32 form an exhaust passage 33.

Figure 2:
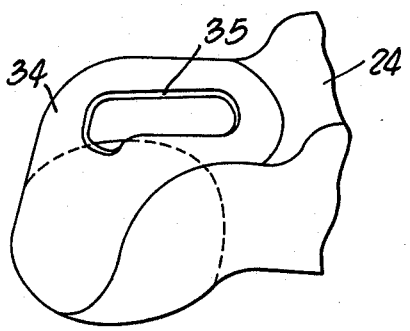
FIG. 2 is a perspective view showing a portion of the liner.
Figure 3:
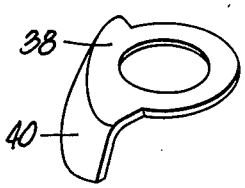
FIG. 3 is a perspective view of a tongue element and which is used to close the aperture or slot in the liner.

The liner 24 has a forward portion 34 and as best shown in FIG. 2 of the drawings this forward portion 34 has an elongated aperture or slot 35. This slot 35 extends into a curved portion of the liner 24 in the direction of the insertion movement of the liner 24 into the exhaust port 21. The valve stem 17, when installed, and a portion of the valve stem guide 36 extend through this slot 35. Means are provided for securing the liner 24 to the valve stem guide 36, and, as shown in the drawings, this means includes a spacer washer 37, a tongue element 38, and a split retainer ring 39. The tongue element 38 has a shield portion 40 which underlies the slot 35 to minimize flow of exhaust gases through the slot.

Figure 4:
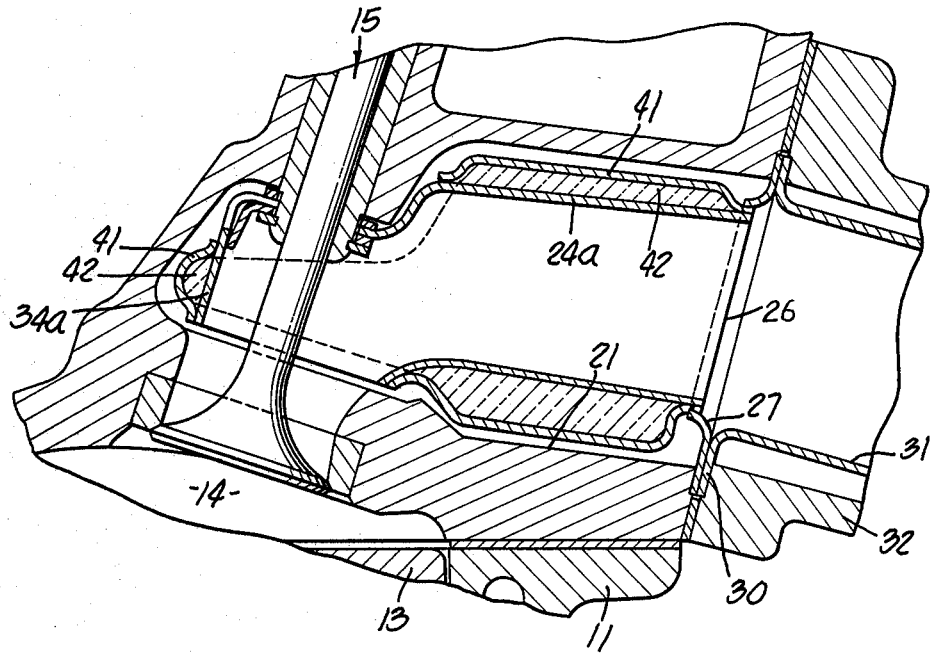
FIG. 4 is a sectional elevation showing a modification.

In the modified form of the invention shown in FIG. 4, the liner **24*a* includes an encircling metal shell 41 containing a layer of heat insulating material 42. A portion of the shell 41 encircles the forward portion 34*a* of the liner 24*a* and contains heat insulating material 42. The liner 24*a* including the shell 41 is spaced from the walls which form the exhaust port 21. The liner 24*a*** is supported in the manner previously described.

Figure 5:
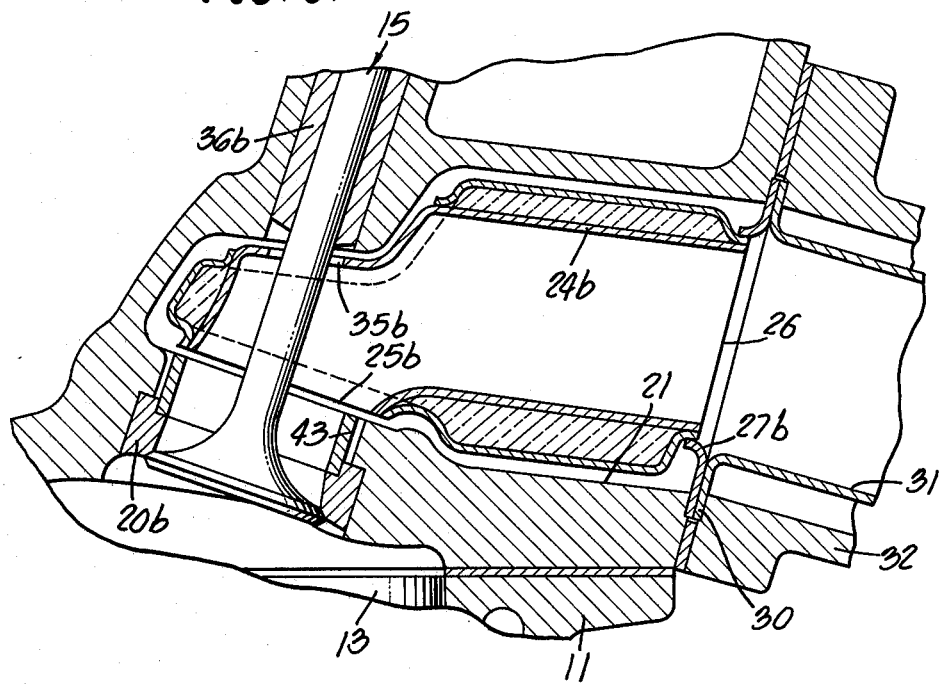
FIG. 5 is a sectional elevation showing a second modification.

In the modified form of the invention shown in FIG. 5, the construction of the liner **24*b* is similar to that described in connection with the liner 24*a* of FIG. 4 except that the liner 24*b* is not attached to the stationary valve guide 36*b* and no tongue element is provided for reducing flow of exhaust gases through the aperture 35*b*. Also, a sleeve 43 is fixed relative to the valve seat 20*b* and serves to direct exhaust gases into the entrance opening 25*b* of the liner 24*b*. This feature is the subject of the copending application of Tasuku Date et al Ser. No. 677,666 filed Apr. 16, 1976. Further, the support flange 27*b* is welded onto the liner 24*b* in a location adjacent to the discharge opening 26**.

In all of the forms of the invention illustrated in the drawings, the support flange 27 not only supports the liner adjacent its discharge opening, but this support flange 27 also serves to block flow of exhaust gases in the clearance space between the liner and the exhaust port 21 in the cylinder head.

Having fully described our invention, it is to be understood that we are not to be limited to the details herein set forth but that our invention is of the full scope of the appended claims.

We claim:

1. In an internal combustion engine having an exhaust valve assembly operatively interposed between a combustion chamber and walls forming an exhaust port, the valve assembly having a poppet valve movable in a stationary guide to close against a stationary seat, the improvement comprising, in combination: an elongated exhaust port liner positioned within the exhaust port and spaced from the walls thereof, said liner being shaped for insertion into operative position through the discharge end of the exhaust port, said liner having an entrance opening at one side through which the valve extends, said liner having a discharge opening remote from said entrance opening, a portion of the liner being provided with a slot for reception of a portion of said valve and said stationary guide, a tongue element positioned to restrict flow of exhaust gases through said slot, means for securing said liner and said tongue element to the stationary guide, and a stationary flange contacting said walls and slidably supporting said liner adjacent its discharge opening.

2. The combustion set forth in claim 1 in which said tongue element has an opening receiving a portion of said stationary guide, and has a shield portion positioned adjacent said slot in said liner.

3. In an internal combustion engine having an exhaust valve assembly operatively interposed between a combustion chamber and walls forming an exhaust port, the valve assembly having a poppet valve movable in a stationary guide to close against a stationary seat, the guide having a portion projecting into said port, the improvement comprising, in combination: an elongated exhaust port liner positioned within the exhaust port and spaced from the walls thereof, said liner being shaped for insertion into operative position, in the absence of the poppet valve, through the discharge end of the exhaust port, the liner having a curved portion provided with a slot extending in the direction of such insertion to receive a portion of said stationary guide, a tongue element positioned to restrict flow of exhaust gases through said slot, releasable means for securing said liner and said tongue element to said stationary guide, and a stationary flange contacting said walls and slidably supporting said liner adjacent its discharge opening.

4. The combination set forth in claim 3 in which said tongue element has an opening receiving a portion of said stationary guide, and has a shield portion positioned adjacent said slot in said liner.

5. The combination set forth in claim 1 including insulation means surrounding at least a portion of said liner.

* * * * *

UNITED STATES PATENT AND TRADEMARK OFFICE

CERTIFICATE OF CORRECTION

PATENT NO. : 4,089,163

DATED : May 16, 1978

INVENTOR(S) : SHUICHI YAMAZAKI et al

It is certified that error appears in the above-identified patent and that said Letters Patent are hereby corrected as shown below:

Column 1, line 47, change numeral "4" to read --14--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*